US005955157A

United States Patent [19]

Hardy

[11] Patent Number: 5,955,157

[45] Date of Patent: Sep. 21, 1999

[54] DECORATIVE CANDLE HOLDER

[75] Inventor: Christopher Hardy, Springfield, Ill.

[73] Assignee: Design Ideas, Ltd., Springfield, Ill.

[21] Appl. No.: 08/779,589

[22] Filed: Jan. 6, 1997

[51] Int. Cl.[6] ..... A63H 33/30; F21V 35/00

[52] U.S. Cl. ..... 428/13; D26/9; D26/16; 428/15; 431/125; 431/289; 446/479

[58] Field of Search ..... D26/9, 14, 16; 362/249; 431/125, 289; 446/479; 428/13, 15

[56] References Cited

U.S. PATENT DOCUMENTS

| | | | |
|---|---|---|---|
| D. 257,641 | 12/1980 | Taylor | D26/6 |
| 629,791 | 8/1899 | Kiesele | 248/216.1 X |
| 2,503,587 | 4/1950 | Murphy | 431/125 |
| 2,671,982 | 3/1954 | Glover | 446/479 |
| 2,735,285 | 2/1956 | Ferleger | 431/288 |
| 3,385,084 | 5/1968 | MacDonald | 431/310 |
| 3,806,723 | 4/1974 | Ollom | 431/289 |
| 4,182,071 | 1/1980 | Todokoro | 446/479 |
| 4,818,215 | 4/1989 | Taga | 428/16 X |

*Primary Examiner*—Henry F. Epstein
*Attorney, Agent, or Firm*—Saidman DesignLaw Group

[57] ABSTRACT

A candle holder specially shaped so as to resemble a TV set. The body portion of the candle holder is preferably made of glass and is relatively opaque except for a screen simulative portion recessed into a front wall thereof which is relatively translucent. The candle holder also may include means for simulating a "rabbit ears" antenna in the form of bent wire mounted in a rear wall and extending upwardly therefrom. A lit candle may be placed on the floor of the candle holder through an upper opening formed by the front wall, rear wall and side walls.

20 Claims, 5 Drawing Sheets

DECORATIVE CANDLE HOLDER

BACKGROUND OF THE INVENTION

1. Field of the Invention

This invention relates to a candle holder, and more particularly to a decorative candle holder.

2. Description of Related Art

Many candle holders for holding many different sizes and kinds of candles are known. Some, for example, are designed to hold a single taper, while others are designed to hold a votive candle. For the latter type, many candle holders are shaped generally in the form of glass cubes which are open at the top to allow for insertion, burning and removal of the votive candle.

Such candle holders all function in essentially the same manner, i.e., one places a candle in the holder and lights it. Thus, the only thing that distinguishes one candle holder from another is frequently its appearance. The shape and style of the candle holder, therefore, operates as an important determinant, and is frequently the major factor, in the commercial success of the product.

Designers of candle holders are therefore constantly devising original shapes and styles for their products, in the hope of creating a new product idea that will appeal to customers.

The present invention was developed with the above-noted general object in mind.

SUMMARY OF THE INVENTION

The present invention achieves the foregoing and other objects by providing a candle holder which comprises a body portion adapted to hold a lit candle therein, the body portion including a front wall, side walls, and a bottom wall, the bottom wall including a floor on which the candle is adapted to be positioned. The body portion is formed to look like a TV set.

The front wall of the body portion preferably includes screen simulating means formed to look like a TV screen. The screen simulating means is preferably recessed from and is more translucent than the rest of the front wall of the body portion. In other words, the body portion is more opaque than the screen simulating means.

The front wall of the body portion may also include knob simulating means formed to look like a TV knob. The knob simulating means, which may comprise a pair of knobs, preferably protrudes outwardly from the front wall of the body portion.

In accordance with another aspect of the present invention, the body portion of the candle holder further preferably includes antenna simulating means extending upwardly therefrom and formed to look like a TV antenna. The antenna simulating means may include a wire portion bent in a shape to simulate a rabbit ears or other style of TV antenna. A rear wall preferably extends between the side walls of the body portion and has a recess formed therein, wherein a means for holding the wire portion is mounted.

The front wall, side walls and rear wall of the candle holder combine to surround the floor and form an opening at the top of the candle holder through which the candle may be placed.

In accordance with another aspect of the present invention, there is provided a holder for a candle, which comprises a body portion adapted to hold a lit candle therein, the body portion including means for simulating a screen formed to look like a TV screen, the means for simulating a screen being more translucent than the rest of the body portion.

In accordance with another aspect of the present invention, there is provided a candle holder, which comprises a glass body portion open at the top thereof and having a floor for holding a lit candle thereon, the glass body portion including means for simulating a TV set formed integrally therein, and wire means for simulating a TV antenna extending from the glass body portion.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

DETAILED DESCRIPTION OF THE PREFERRED EMBODIMENTS

Figure 1:
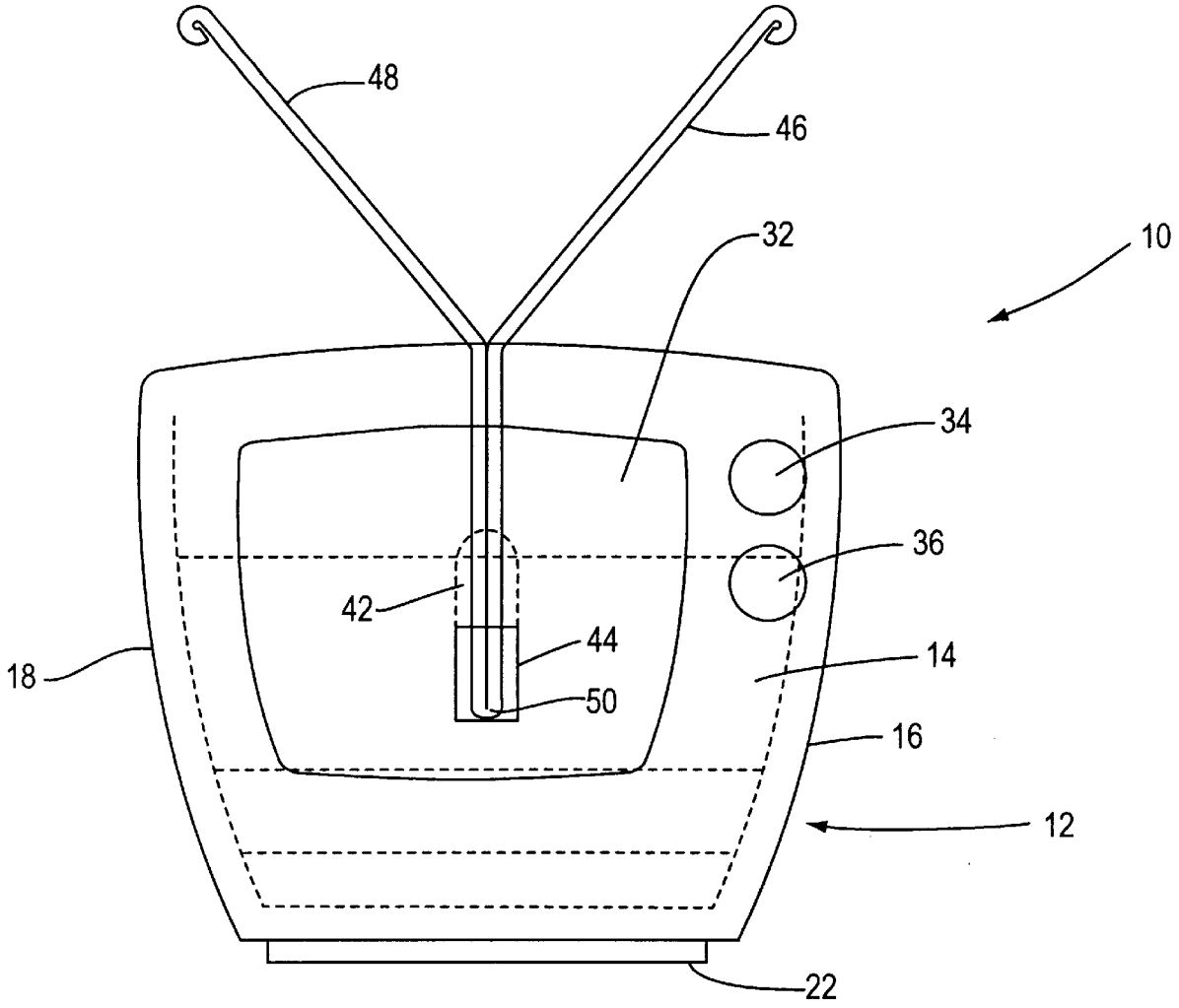
FIG. 1 is a front plan view which illustrates a preferred embodiment of the present invention.
Figure 2:
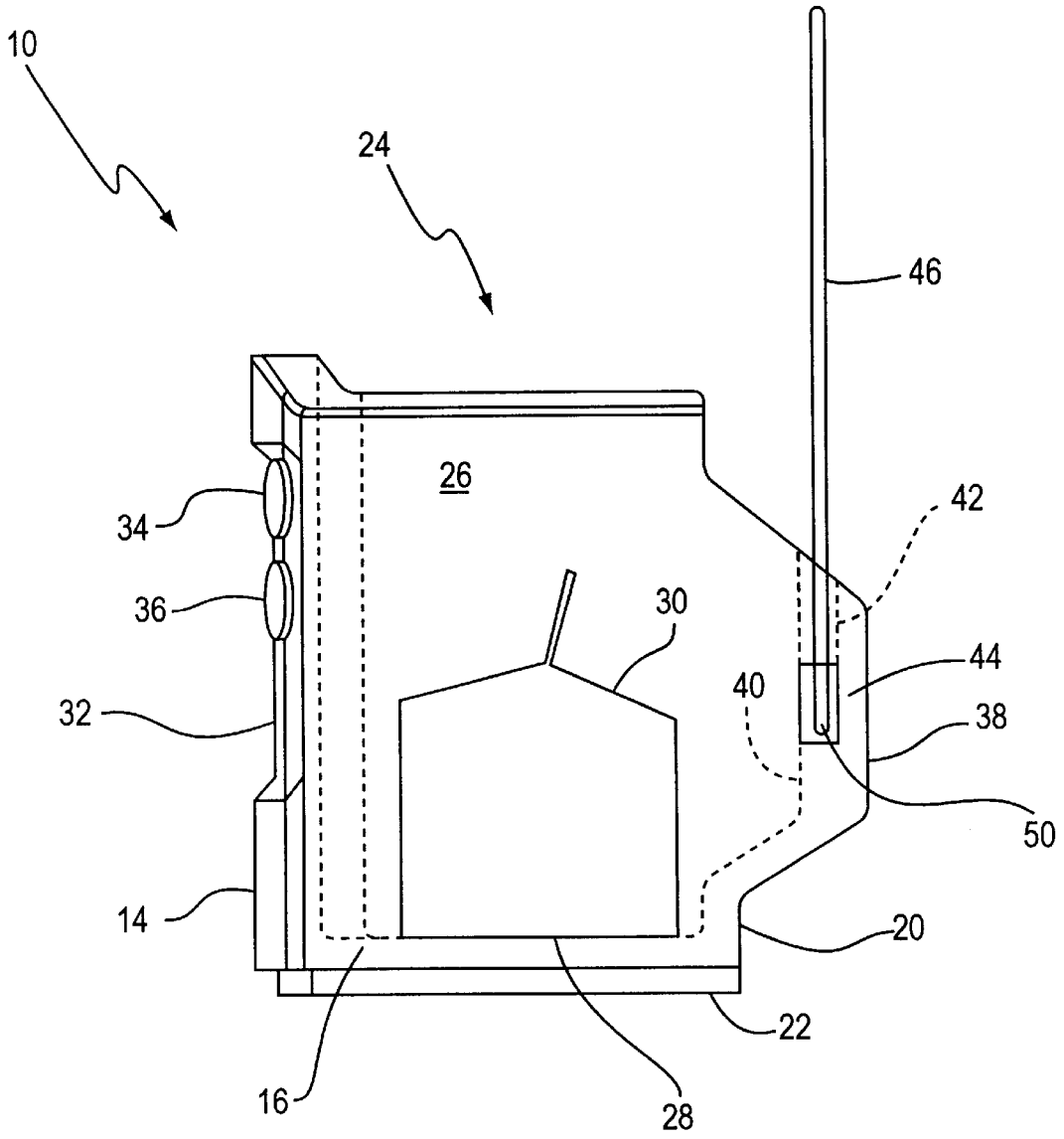
FIG. 2 is a side view of the preferred embodiment of FIG. 1.
Figure 3:
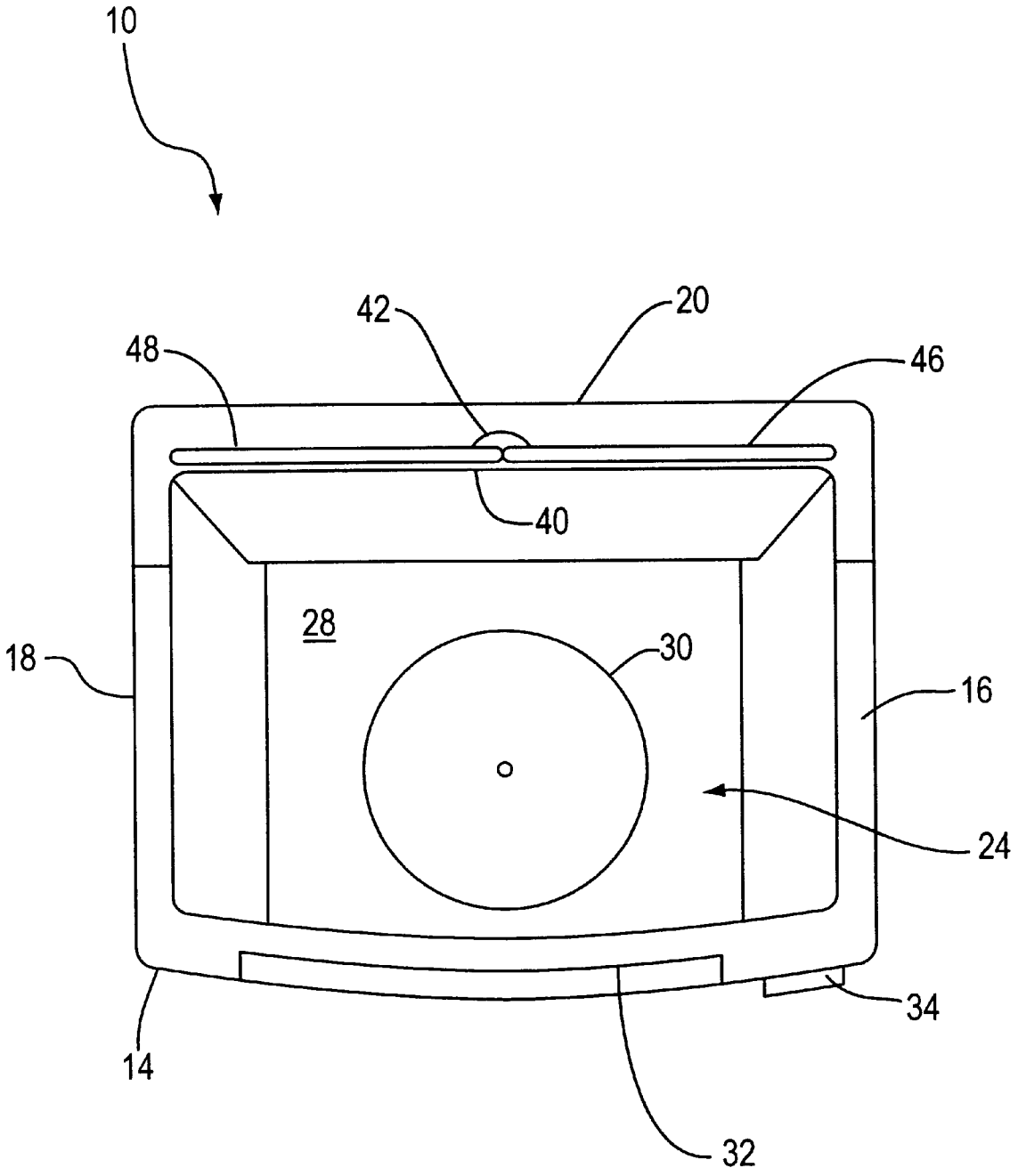
FIG. 3 is a top view of the preferred embodiment of FIG. 1.

Referring now to the drawings, wherein like reference numerals represent identical or corresponding parts throughout the several views, and more particularly to FIGS. 1–3 thereof, the candle holder of the present invention is indicated generally by reference numeral 10.

Candle holder 10 generally comprises a body portion 12, preferably made of glass. In accordance with the present invention, body portion 12 is shaped in the form of and to look like a TV set.

More particularly, body portion 12 includes a front wall 14 from which rearwardly extends a pair of side walls 16 and 18. A bottom wall 22 is shaped to resemble a TV stand or base, and side walls 16 and 18 in this preferred embodiment extend upwardly and outwardly from base 22.

Body portion 12 also preferably includes a rear wall 20 which will be described in greater detail below.

As seen best in FIGS. 2 and 3, walls 14, 16, 18 and 20 form an open top 24 and an inner chamber 26. The latter is also defined by floor 28 on which a candle, such as votive 30, is placed.

Front wall 14 preferably includes a screen portion 32 formed thereon which is provided to simulate a TV screen. Screen portion 32 is preferably recessed from the outer surface of front wall 14. In addition, screen portion 32 (which may be provided in a number of different shapes and sizes) is preferably made more translucent than the rest of front wall 14, and preferably is more translucent that the entire rest of body portion 12. This has the desirable effect of simulating a "live" TV screen when a candle 30 is lit and burning in the position shown in FIG. 2. In the commercial embodiment, the body portion 12 for example is painted a dark blue color, while screen portion 32 is frosted white and thus is more translucent than the blue portion.

Positioned adjacent screen portion 32 are preferably formed a pair of "knobs" 34 and 36 which are provided to simulate TV knobs. Knobs 34 and 36 in the preferred embodiment are formed as protrusions which extend beyond the surface of front wall 14; however, other constructions are possible.

Rear wall 20, as seen in FIG. 2, includes a protruding portion 38 which is also shaped to simulate the rear portion of a TV set that normally houses the protruding end of the cathode ray tube.

On the inside surface 40 of protruding portion 38 of rear wall 20 is formed a semi-cylindrical recess 42 which is adapted to accommodate means 44 for mounting "rabbit ears" antennas 46 and 48. The antenna simulating means is preferably formed as a single piece of metal wire bent as at 50 and shaped to simulate the rabbit ears or other type of antennas normally used indoors with TV sets.

The mounting means 44 preferably comprises a small piece of acrylic plastic having an aperture (not shown) formed therein for receiving the bent end 50 of antennas 46, 48. End 50 may preferably be press fit within the aperture in acrylic plastic mounting means 44. The latter, in turn, may be adhesively secured to recess 42 by, for example, solvent.

Figure 4:
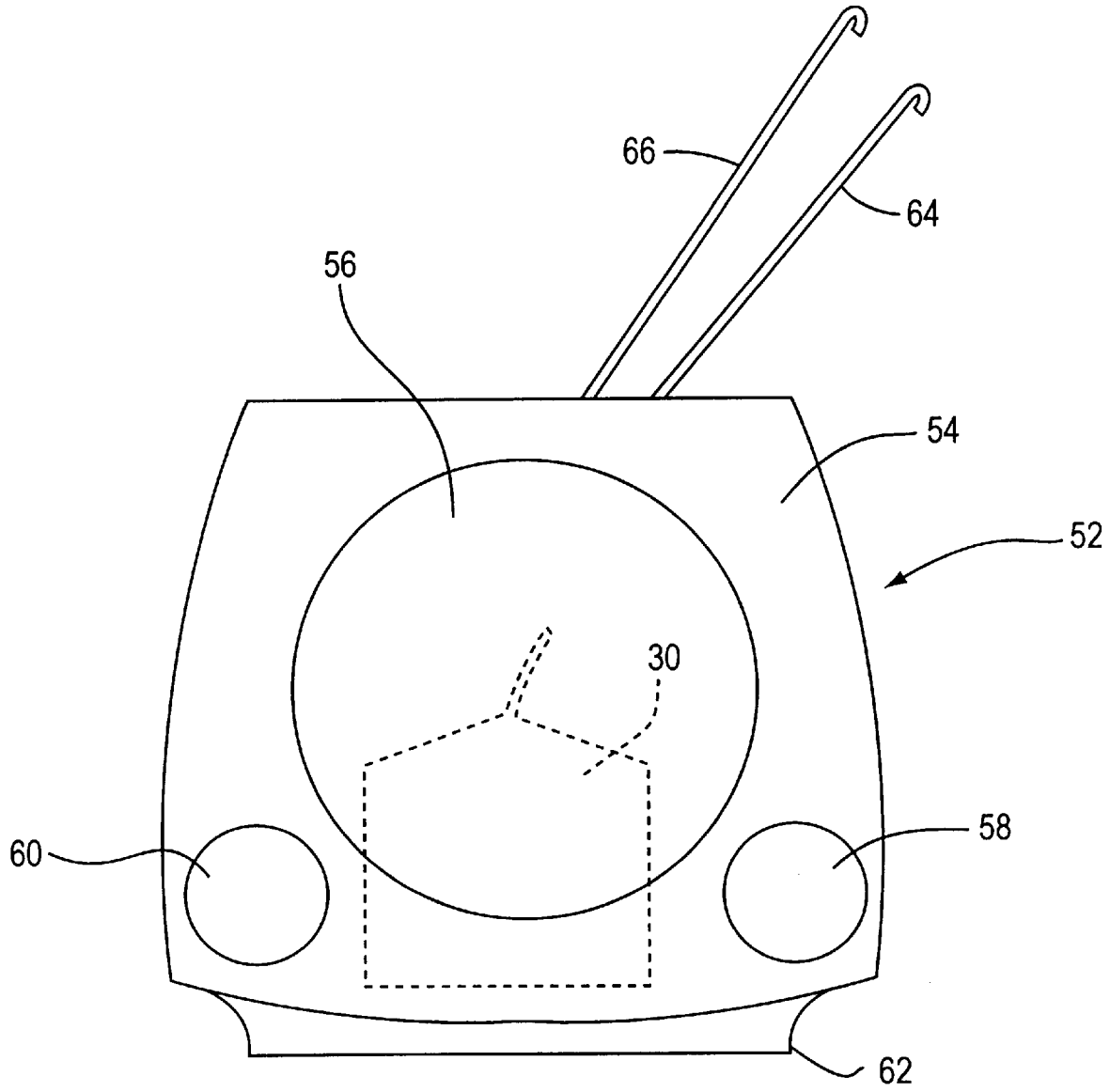
FIG. 4 is a front plan view of an alternate embodiment of the present invention.

An alternate embodiment of the present invention is shown in FIG. 4 wherein a differently shaped body portion 52 includes a front wall 54 having a round screen-simulating portion 56, a pair of round knobs 58 and 60, and a base portion 62. In addition, rabbit ears antennas 64 and 66 may also be provided.

Figure 5:
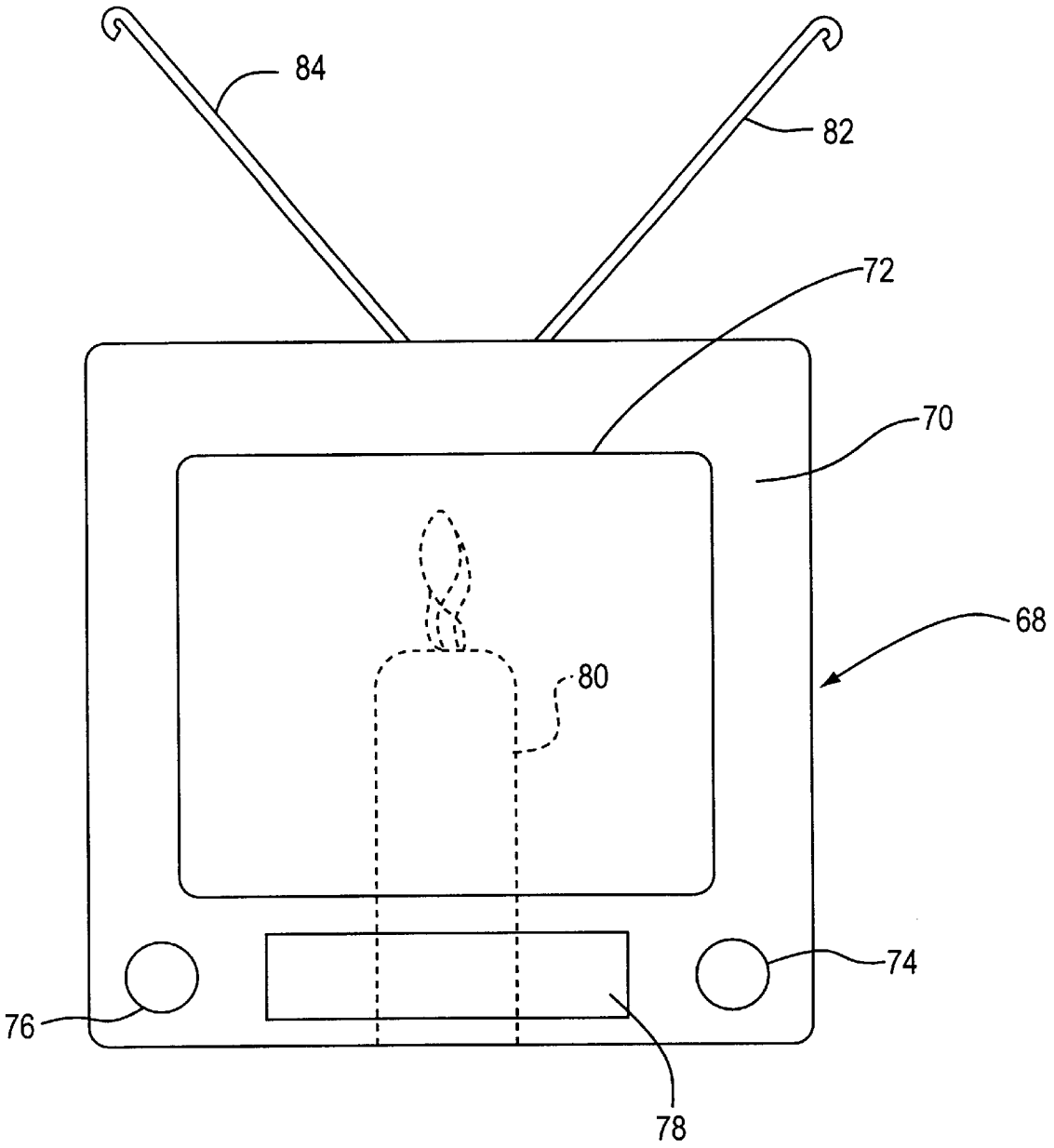
FIG. 5 is a front plan view of yet another alternate embodiment of the present invention.

A still further alternate embodiment of the present invention is shown in FIG. 5 wherein body portion 68 is substantially square shaped and includes a front wall 70 having a square screen 72, knobs 74 and 76, a control panel 78 (which may be recessed or protrude from front wall 70 as may be desired), and antennae 82 and 84. A taper candle 80 may be provided instead of the votive of the previous embodiments.

Those skilled in the art will appreciate that the conception, upon which this disclosure is based, may readily be utilized as a basis for designing other products for carrying out the several purposes of the present invention. It is important, therefore, that the claims be regarded as including such equivalent constructions insofar as they do not depart from the spirit and scope of the present invention as defined in the appended claims.

Further, the purpose of the following Abstract is to enable the U. S. Patent and Trademark Office, and the public generally, and especially the designers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

I claim as my invention:

1. A candle holder, which comprises:

a glass body portion adapted to hold a lit candle therein;

said body portion including a front wall, side walls, and a bottom wall;

said bottom wall including a floor on which the candle is adapted to be positioned;

said body portion formed to look like a TV set.

2. The candle holder as set forth in claim 1, wherein said front wall of said body portion includes screen simulating means formed to look like a TV screen.

3. The candle holder as set forth in claim 2, wherein said screen simulating means is recessed from said front wall of said body portion.

4. The candle holder as set forth in claim 2, wherein said screen simulating means is more translucent than the rest of said front wall of said body portion.

5. The candle holder as set forth in claim 2, wherein said body portion is more opaque than said screen simulating means.

6. The candle holder as set forth in claim 1, wherein said front wall of said body portion includes knob simulating means formed to look like a TV knob.

7. The candle holder as set forth in claim 6, wherein said knob simulating means protrudes outwardly from said front wall of said body portion.

8. The candle holder as set forth in claim 6, wherein said knob simulating means includes a pair of knobs protruding outwardly from said front wall of said body portion.

9. The candle holder as set forth in claim 1, wherein said body portion further includes antenna simulating means extending upwardly therefrom and formed to look like a TV antenna.

10. The candle holder as set forth in claim 9, wherein said antenna simulating means includes a wire portion bent to simulate a TV antenna.

11. The candle holder as set forth in claim 10, wherein said wire portion is bent in a shape to simulate a rabbit ears TV antenna.

12. The candle holder as set forth in claim 10, further comprising means for holding said wire portion.

13. The candle holder as set forth in claim 12, wherein said body portion further comprises a rear wall extending between said side walls and having a recess formed therein, said means for holding said wire portion mounted to said recess on said rear wall.

14. The candle holder as set forth in claim 1, wherein said body portion further comprises a rear wall extending between said side walls, said front wall, side walls and rear wall combining to surround said floor and form an opening at the top of said candle holder through which the candle may be placed.

15. A holder for a candle, which comprises:

a glass body portion adapted to hold a lit candle therein;

said body portion including means for simulating a screen formed to look like a TV screen, said means for simulating a screen being more translucent than the rest of said body portion.

16. The holder as set forth in claim 15, further comprising means for simulating a TV antenna extending upwardly from said body portion.

17. The holder as set forth in claim 16, wherein said TV antenna simulating means comprises a wire bent to simulate a TV antenna.

18. A candle holder, which comprises:

a glass body portion open at the top thereof and having a floor for holding a lit candle thereon;

said glass body portion including means for simulating a TV set formed integrally therein; and wire means for simulating a TV antenna extending from said glass body portion.

19. The candle holder as set forth in claim 18, wherein said means for simulating a TV set includes a screen portion formed in said body portion, said screen portion being more translucent than the rest of said body portion.

20. The candle holder as set forth in claim 19, further comprising knob simulating means formed in said body portion to resemble a TV knob.

* * * * *